US006450161B1

(12) United States Patent
Izumi

(10) Patent No.: US 6,450,161 B1
(45) Date of Patent: Sep. 17, 2002

(54) PORTABLE COOKING SYSTEM

(75) Inventor: Satoshi Izumi, Tokyo (JP)

(73) Assignee: On Way Co., Ltd., Tokyo (JP)

( * ) Notice: Subject to any disclaimer, the term of this patent is extended or adjusted under 35 U.S.C. 154(b) by 0 days.

(21) Appl. No.: 09/437,433

(22) Filed: Nov. 17, 1999

(51) Int. Cl.[7] ..... F24C 1/16; A47C 13/00; A47C 7/72

(52) U.S. Cl. ..... 126/9 R; 297/45; 297/153; 297/162; 297/173

(58) Field of Search ..... 126/25 R, 9 R, 126/9 B, 38, 304 R, 304 A; 297/135, 158.4, 158.5, 148, 170, 173, 248, 160, 162, 232, 44, 45, 153; 190/11, 12 R, 12 A; 211/181.1; 108/60, 64, 128, 157.11, 162, 163, 157.13; 206/541

(56) References Cited

U.S. PATENT DOCUMENTS

| | | | | | |
|---|---|---|---|---|---|
| 506,085 | A | * | 10/1893 | Whelan | 297/248 |
| 793,752 | A | * | 7/1905 | Unger et al. | 297/153 |
| 1,082,884 | A | * | 12/1913 | Leonard | 297/153 |
| 1,858,254 | A | * | 5/1932 | Uline | 297/248 |
| 3,147,036 | A | * | 9/1964 | McRae | 190/12 R |
| 3,722,011 | A | * | 3/1973 | Miller | 297/193 |
| 4,063,703 | A | * | 12/1977 | Shy | 126/304 A |
| 4,098,486 | A | * | 7/1978 | Hornsby | 108/159 |
| 4,300,798 | A | * | 11/1981 | Musgrove et al. | 297/162 |
| 4,526,419 | A | * | 7/1985 | Bowman et al. | 297/153 |
| 4,566,731 | A | * | 1/1986 | Marchesini | 297/45 |
| 4,591,206 | A | * | 5/1986 | Pribble | 297/148 |
| 4,760,801 | A | * | 8/1988 | Campbell | 108/119 |
| 5,570,928 | A | * | 11/1996 | Stauton et al. | 297/232 |
| 5,775,315 | A | * | 7/1998 | Bayka | 126/25 R |
| 5,862,967 | A | * | 1/1999 | Johnson | 224/577 |
| 5,873,624 | A | * | 2/1999 | Simpson | 297/45 |
| 6,098,611 | A | * | 8/2000 | Filmore | 126/9 R |

FOREIGN PATENT DOCUMENTS

| | | | |
|---|---|---|---|
| JP | 10272014 | * | 10/1998 |
| JP | 2000-225033 A | * | 8/2000 |
| JP | 2000-236982 A | * | 9/2000 |
| JP | 2001-61597 A | * | 3/2001 |

* cited by examiner

*Primary Examiner*—Henry Bennett
*Assistant Examiner*—Josiah C. Cocks
(74) *Attorney, Agent, or Firm*—Katten Muchin Zavis Roseman

(57) ABSTRACT

A portable cooking system comprising: leg units each having a pair of leg posts, first and second reinforcement mechanisms that connects the leg units to stand as well as to be folded together, a first cloth material over the first reinforcement mechanism, a second cloth material over the second reinforcement mechanist; a removable back cloth material between the leg posts on one side of the leg units, side tables rotatably installed to the opposite sides of the combined leg units, a removable lantern stand, and a removable wire net and top board, wherein the leg units, first and second reinforcement mechanisms, and cloth materials can form a bench, and wherein with the back cloth material removed, the leg units, reinforcement mechanisms, cloth materials, side tables, the lantern stand, and wire net and/or top board can form a kitchen.

4 Claims, 2 Drawing Sheets

PORTABLE COOKING SYSTEM

FIELD OF THE INVENTION

This invention relates to a kitchen equipped with a lantern stand, and in more particular to a portable cooking system that can be converted to a bench.

BACKGROUND OF THE INVENTION

Recently, outdoor leisure has become very diversified, which has brought about a need for highly convenient outdoor goods that can be used for more than one purpose.

When cooking outdoors a stove with fuel burning burners is used, and an outdoor kitchen which includes that stove, as well as a Top Board or cooking table on which a water tank (jug), food and the like are placed is necessary.

Up until now, it has only been possible to place the stove on the stove stand, so a table-shaped kitchen such as a mesh-style table that does not obstruct air flow to the stove, and a Top Board or side table to be used as a cooking table on which food and other cooking utensils and cookware can be placed was located near the stand at an easy-to-use height. Moreover, it would be good if the legs of this kitchen could be folded so it could be easily stored, and be more convenient when carrying it.

However, since that kitchen could only be used for cooking, cooking utensils and cookware where left on the top of the kitchen, and a problem arose that it could only used for one purpose.

Therefore, there was a need for a convenient kitchen that could become portable by folding it up, and that could be used for purposes other than for cooking.

SUMMARY OF THE INVENTION

The portable cooking system of this invention is capable of functioning as a kitchen which has a table for placing cooking equipment and is equipped with a lantern stand; and after cooking is finished, it is also capable of functioning as a bench for sitting.

When functioning as a bench, it comprises a first, second and third leg unit that has a pair of leg posts which are parallel with each other and where one of the end of each leg post is placed on the same horizontal surface, a first reinforcement mechanism that connects the first and second leg units, and which makes it possible for them to stand parallel with each other as well as makes it possible to fold them together, a second reinforcement mechanism that connects the second and third leg units, and which makes it possible for them to stand parallel with each other as well as makes it possible to fold them together, a first cloth material that is spread out horizontally over the first reinforcement mechanism, a second cloth material that is spread out horizontally over the second reinforcement mechanism; a removable back cloth material that extends from the other end of one of the leg posts of the first, second and third leg unit, a first side table that is installed such that it can rotate with respect to the first leg unit in the direction opposite that of the second leg unit and can be secured in a horizontal position, and a second side table that is installed such that it can rotate with respect to the third leg unit in the direction opposite that of the second leg unit and can be secured in a horizontal position.

When functioning as a kitchen, the aforementioned back cloth material is removed, a removable lantern stands are placed on the aforementioned other ends of the leg posts of the first, second and third leg units, and a removable wire net and/or top board is placed horizontal over the first and second leg units and/or second and third leg units.

The construction described above has the following features:

1. The cooking system can be stored compactly and conveniently carried.
2. The frame is all one unit, so it can be opened or closed easily, and it is stable during use.
3. When used as a kitchen, the extended cloth material and the top board function as a double-layer storage space, and with the tables on both sides, there is a lot of usable space while at the same time being very compact.

BRIEF EXPLANATION OF THE DRAWINGS

An embodiment of the invention is shown in the figures for the detailed explanation of the invention below.

DETAILED EXPLANATION OF THE INVENTION

Figure 1:
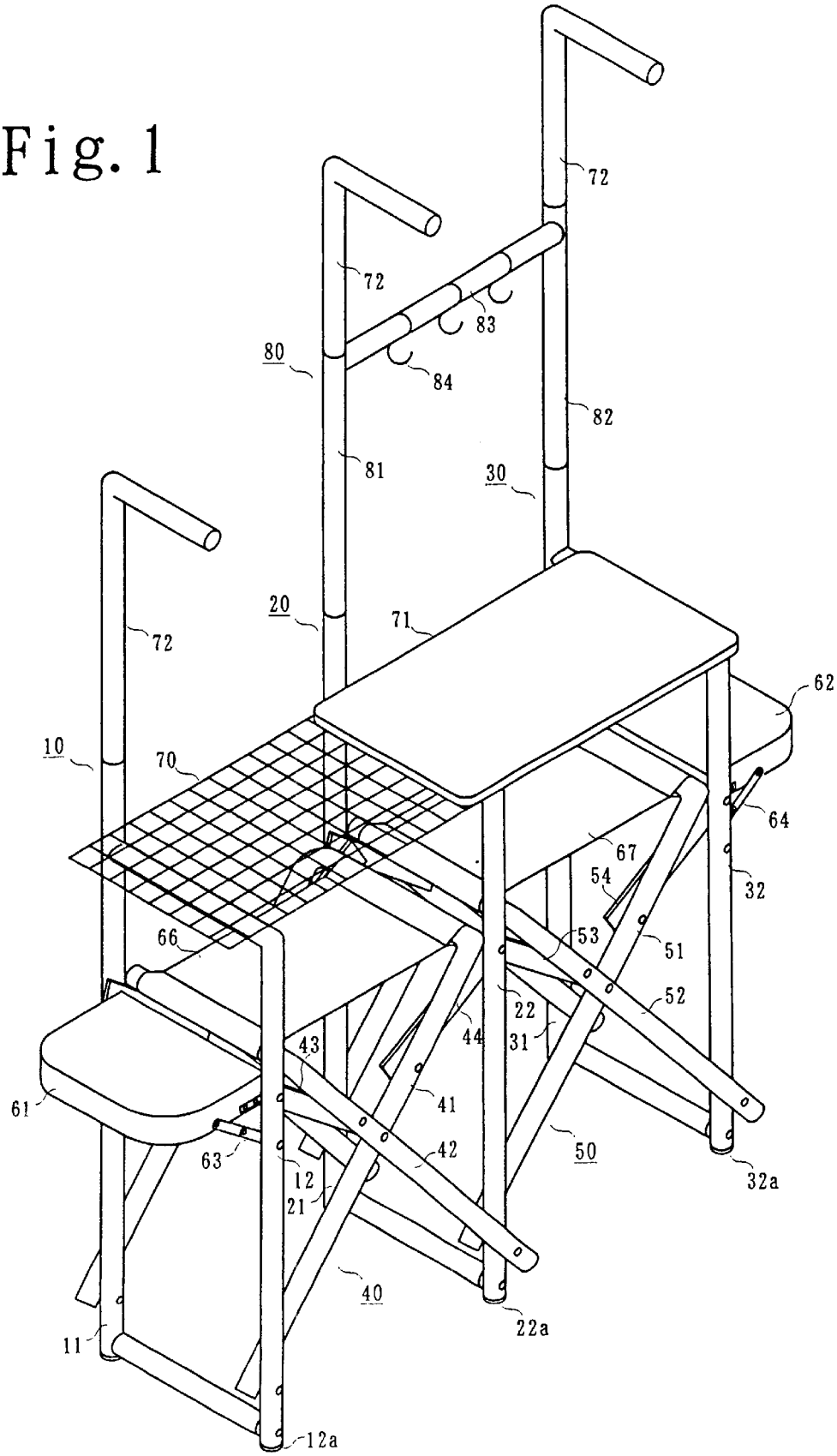
FIG. 1 is a pictorial view of an embodiment of this invention when used as a kitchen.
Figure 2:
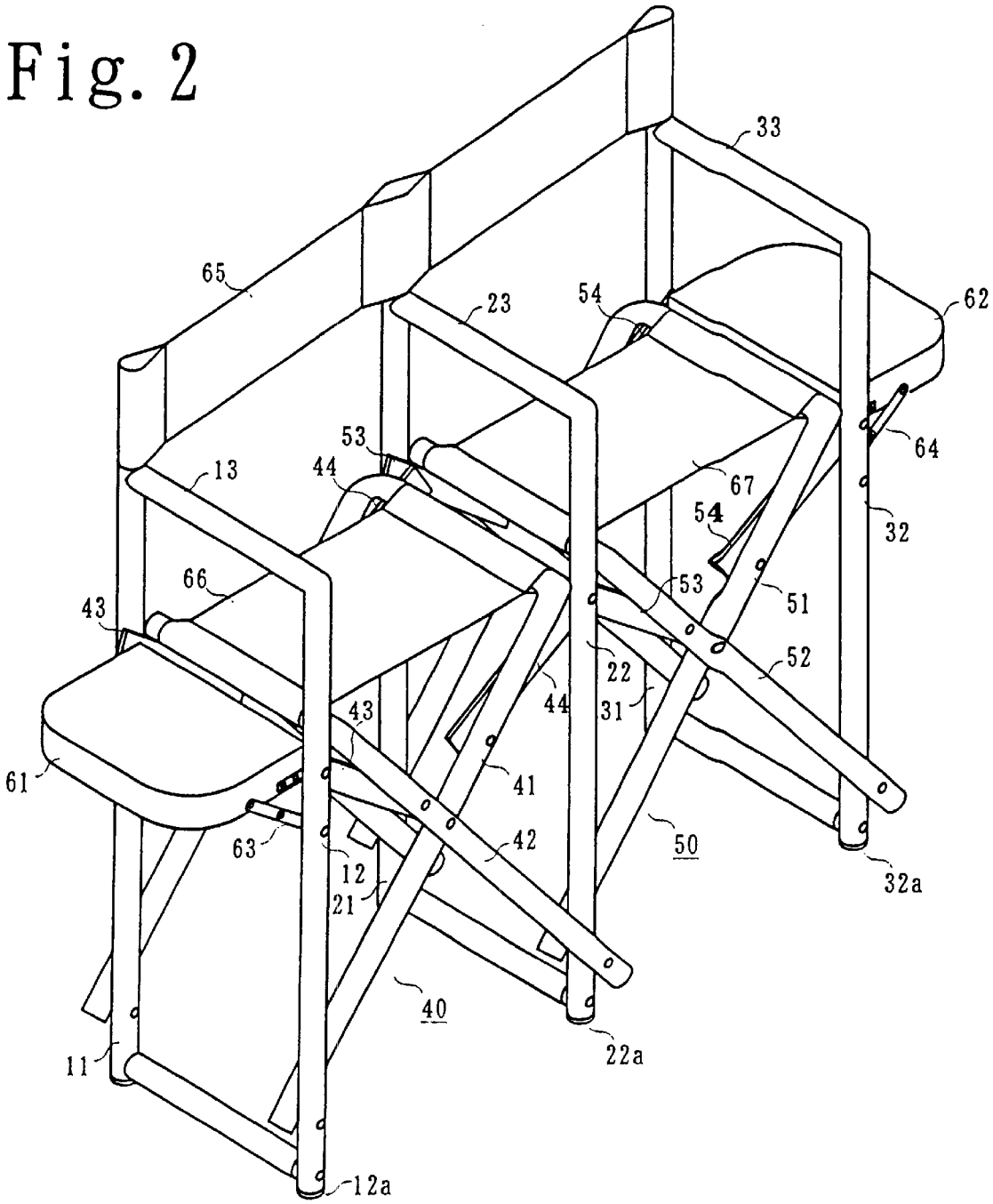
FIG. 2 is a pictorial view of an embodiment of this invention when used as a bench.

The portable cooking system of this invention is compact, has an integrated easy-to-carry frame, has good stability and a large working area. Moreover, it can be used as both a kitchen and a bench. One embodiment of this invention is described below with reference to FIGS. 1 and 2.

The system has the following configuration when used as a bench.

There is a first leg unit 10, having two leg posts 11, 12 which are fixed such that they are parallel with each other and such that one end, in particular the bottom end, comes in contact with the ground, a second leg unit 20, having two leg posts 21, 22 which are fixed such that they are parallel with each other and such that one end, in particular the bottom end, comes in contact with the ground, and a third leg unit 30, having two leg posts 31, 32 which are fixed such that they are parallel with each other and such that one end, in particular the bottom end, comes in contact with the ground. The ends of the these leg posts that come in contact with the ground are connected as described below so that they are placed on the same horizontal surface.

There is a first reinforcement mechanism 40 that connects the first leg and second leg units 10, 20 such that they can stand parallel to each other and such that they can be folded together, and there is a second reinforcement mechanism 50 that connects the second leg and third leg units 20, 30 such that they can stand parallel to each other and such that they can be folded together.

A first cloth material 66 is spread horizontal above the first reinforcement mechanism 40, and there is a second cloth material 67 is spread horizontal above the first reinforcement mechanism 50.

On the other ends of one of the leg posts 11, 21, 31 of the first, second and third leg units 10, 20, 30, in particular the top ends, there is a removable back cloth material 65.

There is a first side table 61 that is installed such that it can rotate with respect to the first leg unit 10 in the direction opposite that of the second leg unit 20 and can be secured in a horizontal position, and a second side table 62 that is installed such that it can rotate with respect to the third leg unit 30 in the direction opposite that of the second leg unit 20 and can be secured in a horizontal position.

The construction is explained in detail below.

The first, second and third log units 10, 20, 30 are made of pipe such as aluminum or steel pipe. On one end, or in other words, the bottom end, there are removable rubber caps 12*a*, 22*a*, 32*a* for protection The leg posts 11, 12, 21, 22, 31, 32 are separated by a specified interval and are secured such that they are parallel so that the aforementioned ends, namely the bottom ends, are even. They can be secured as shown in the figures by preparing a pipe that corresponds to the interval between leg posts, and using it to secure both ends.

The bottom ends are the ends that come in contact with the ground, so on the top ends the pipes are cut and the opening is smoothed round.

Also, the middle of the leg posts 12, 22, 32 are bent at right angles and the ends, namely the top ends, are fastened to the other leg posts 11, 21, 31, while the horizontal section becomes the arm rests 13, 23, 33 to be described later.

The first reinforcement mechanism 40 comprises a first and second U-shaped member 41, 42, that have a connecting section and two extending sections that are bent at right angles to the connecting section and extend in the same direction, and four attachment fittings 43, 44.

The bottom ends (one of the ends of the extending sections of the U-shaped members are attached to both ends of the connecting section, or are formed as one piece with the connecting section, and the other ends are cut pipe whose opening is rounded smooth, or if necessary is fitted with a cap, and since these ends are always located at the bottom, they are the bottom end) of the two extending sections of the first U-shaped member 41 are attached near one end of the leg posts 11, 12 of the first leg unit 10, and the ends, namely the bottom ends, of the two extending sections of the second U-shaped member 42 are attached near one end of the leg posts 21, 22 of the first leg unit 20, such that they can rotate. The center of one of the extending sections of the first U-shaped member 41 is attached to the center of one of the extending sections of the second U-shaped member 42 such that they can rotate, and the center of the other extending section of the first U-shaped member 41 is attached to the center of the other extending section of the second U-shaped member 42 such that they can rotate. Two of the attachment fittings 43 are attached to the extending sections of the first U-shaped member 41, on the inside from the center of the extending section toward the connecting section, and to the top of the leg posts 11, 12 of the first leg unit 10 such that they can both rotate, and the other two attachment fittings 44 are attached to the extending sections of the second U-shaped member 42, on the inside from the center of the extending section toward the connecting section, and to the top of the leg posts 21, 22 of the second leg unit 20 such that they can both rotate. In order that the first leg unit 10 and the second leg unit 20 can be put together, the first U-shaped member 41 and the second U-shaped member 42 can be folded together, and when the attachment fittings 43, 44 come in contact with the connecting sections of the first U-shaped member 41 and second U-shaped member 42, it is possible to set the first and second leg units 10, 20 such that they are standing parallel to each other.

The second reinforcement mechanism 50 is constructed the same as the first reinforcement mechanism 40, in that it makes it possible for the second leg unit 20 and leg unit 30 to fold together or to stand up parallel to each other.

The first cloth material 66 extends between the connecting section of the first U-shaped member 41 and the connecting section of the second U-shaped member 42.

The second cloth material 67 extends between the connecting section of the second U-shaped member 51 and the connecting section of the second U-shaped member 52. The first cloth material 66 and second cloth material 67 can be rectangular cloth with bag-shaped ends that goes around the connecting sections.

The back cloth 65 fits on the top ends of leg posts 11, 21, 31 on one side of the first, second and third leg units 10, 20, 30, and can be a rectangular cloth of specified length with bag-shaped sections on both ends and in the middle.

The first side table 61 and second side table 62, are attached as a rotating table to the first, second and third leg units 10, 20, 30 at a position that is at that same height as the aforementioned cloth material 66, 67 when the first, second and third leg units 10, 20, 30 are standing parallel to each other, and they can secured in a horizontal position by a well known support mechanism 63, 64. The first and second side tables 61, 62 can be made of wood, and can be supported by an aluminum frame. The are installed so that they can rotate by making holes in them and attaching them with rivets.

With the construction described above, one person can sit down on the cloth material 66 that extends between the first leg unit 10 and the second leg unit 20, and another person can sit down on the cloth material 67 that extends between the second leg unit 20 and the thirds leg unit 30. The middle of the back cloth 65 fits over the end, namely the top end, of the second leg unit 20, so half of the back cloth 65 fits behind the back of each person sitting on the bench. The first and second side tables 61, 62, that are located on the sides of the two people sitting on the bench, are ideal for placing a coffee cup or the like on them and making themselves comfortable, or a cellular phone or mobile computer can be placed on them and used in doing work or enjoying a hobby.

The system has the following configuration when used as a kitchen.

The aforementioned back cloth 65 is removed and a removable lantern stand 72 is placed on the top end of the protruding leg post 11 of the first leg unit 10. An H-shaped member 80 is placed on the top of the protruding leg posts 21, 31 of the first and second leg units 20, 30, and lantern stands 72 are also placed on the top ends of this H-shaped member 80. It is also possible to place a removable lantern stand 72 on the top end of the protruding leg post 31 of the third leg unit 30, and place an H-shaped member 80 on the top ends of the protruding leg posts 11, 21 of the first and second leg units 10, 20, and then place lantern stands 72 on the top ends of the H-shaped member 80. Moreover, it is possible to place lantern stands 72 on the first, second and third leg units 10, 20, 30.

An wire net 70 is fitted on the aforementioned arm rests 13, 23, and a top board 71 is fitted on the aforementioned arm rests 23, 33.

The construction is described in detail below.

The aforementioned lantern stands 72 are made of aluminum or steel pipe with the same diameter as the aforementioned leg posts 1, 21, 31. In order that they may be connected to the leg posts 11, 21, 31 of the aforementioned first, second and third leg units 10, 20, 30 when the center hole has been opened at one end, namely the bottom end, is processed such that the outer diameter is made a little less than the inner diameter, and the other end is bent at a right angle.

The H-shaped member 80 comprises for example, an extension post 81 that connects to the second leg unit 20, an extension post 82 that connects to the third leg unit 30, and one or more horizontal bar 83 that run between and secure the extension posts 81, 82. The extension post 81, 82 are linear. The horizontal bar 83 is formed as a support that corresponds to the space between the second and third leg units 20, 30 when they are standing parallel to each other.

The wire net 70 is a rectangular wire net made of stainless steel and equipped with attachment fittings on both ends in the rear in the width direction that attach to the aforementioned arm rests.

The top board 71 is a rectangular board whose outer edge is reinforced with an aluminum frame and is equipped with attachment fittings on both ends in the rear in the width direction that attach to the aforementioned arm rests.

The attachment fittings are half-pipe shaped and cut halfway or less around the circumference and have an inner diameter equal to the thickness of the aluminum pipe of the arm rest such that the cut section are fastened when facing the center. Also, it is possible to pass the attachment fittings that secure the top board 71 through holes in the wire net 70 and attach them to the arm rests.

With the above construction, the wire net 70 and top board 71 are placed above the cloth material 66, 67, and it is possible to place a stove on the wire net 70, and perform cooking preparation on the top board 71. Moreover, it is possible to place food, cooking utensils or the like on the cloth material 66, 67 on which people sit when the system is used as a bench as described above.

Dishes, such as plates, can be placed on the first and second side tables 61, 62, or placing a water tank on a side table makes it convenient to run water for washing food or for filling pots on the stove. Moreover, it is possible to place soap or detergent on a side table, or to use the side tables to separate food and cookware.

The work area can be lit well by placing lanterns for lighting on the bent sections on the ends of the aforementioned lantern stands 72. Furthermore, hooks 84 can be attached to the horizontal bar 83, and it is possible to hang cooking utensils and the like on these hooks 84.

To store the cooking system, the aforementioned lantern stands 72 and H-shaped member 80 are removed, then by rotating the pair of U-shaped members, they can be folded together.

The cooking system of this invention can be used as a kitchen when cooking and having meals, and during other it can be used as a bench. With the construction above, the cooking system has the following features:

1. The cooking system can be stored compactly and conveniently carried.
2. The frame is all one unit, so it can be opened or closed easily, and it is stable during use.
3. When used as a kitchen, the extended cloth material and the top board function as a double-layer storage space, and with the tables on both sides, there is a lot of usable space while at the same time being very compact.

The shapes and dimensions of the parts described above in the detailed explanation are used as an example and are for the embodiment shown in the drawings, however, this invention is not limited to this example.

What is claimed is:

1. A portable cooking system comprising:

first, second and third leg units each having a pair of leg posts which are parallel with each other and have a first end such that all the first ends are placed an the same horizontal surface, a first reinforcement mechanism that connects the first and second leg units such that the first and second leg units stand parallel with each other and are adapted to be folded together, a second reinforcement mechanism that connects the second and third leg units such that the second and third leg units stand parallel with each other and are adapted to be folded together, a first cloth material spread out horizontally over the first reinforcement mechanism, a second cloth material spread out horizontally over the second reinforcement mechanism;

a removable back cloth material that extends between second ends of the leg posts on one side of the first, second and third leg units, a first side table that is rotatably installed to the first leg unit on the side far from the second leg unit such that it can be secured in a horizontal position, a second side table that is rotatably installed to the third leg unit on the side far from the second leg unit such that it can be secured in a horizontal position, wherein the first, second and third leg units, first and second reinforcement mechanisms, and first and second cloth materials from a bench, at least one removable lantern stand placed on the second ends of the leg posts of the first, second and third leg units, and a removable wire net and top board placed horizontal over the first and second leg units and/or second and third leg units, wherein with the back cloth material removed, the first, second and third leg units, first and second reinforcement mechanisms, first and second cloth materials, first and second side tables, at least one removable lantern stand, and wire net and top board from a kitchen.

2. The portable cooking system of claim 1, wherein the first reinforcement mechanism comprises a first and second U-shaped member that have a connecting section and two extending sections that are bent at right angles at the connecting section and extend in the same direction, and four attachment fittings, the extending sections of the first U-shaped members having a first end that is rotatably attached near the first end of the leg posts of the first leg unit, the extending sections of the second U-shaped members having a first end rotatably attached near the first end of the leg posts of the second leg unit, the extending sections of the first U-shaped member being rotatably attached to the extending sections of the second U-shaped member at a central portion thereof, two of the four attachment fittings being extended between and attached to the leg poles of the first leg unit and the extending sections of the first U-shaped member, and the other two being attached to the leg poles of the second leg unit and the extending sections of the second U-shaped member, such that the first and second leg units can be folded together, and that the attachment fittings abut to the connecting sections to keep the first and second leg units standing parallel to each other, and the second reinforcement mechanism comprises a third and fourth U-shaped member that have a connecting section and two extending sections that are bent at right angles at the connecting section and extend in the same direction, and four attachment fittings the extending sections of the third U-shaped members having a first end that is rotatably attached near the first end of the leg posts of the third leg unit, the extending sections of the found U-shaped members having a first end rotatably attached near the first end of the leg posts of the second leg unit, the extending sections of the third U-shaped member being rotatably attached to the extending sections of the fourth U-shaped member at a central portion thereof, two of the four attachment fittings being attached to the leg poles of the third leg unit and the extending sections of the third U-shaped member, and the other two being attached to the leg poles of the second leg unit and the extending sections of the fourth U-shaped member, such that the third and fourth leg units can be folded together, and that the attachment fittings abut to the connecting sections to keep the third and fourth leg units standing parallel to each other.

3. The portable kitchen system of claim 1, wherein the first, second and third leg units are provided with an arm rest, being orthogonal to the leg poles, wherein the wire net and top board are each provided with an engagement fitting engaged with the arm rest, such that when the first, second and third leg units are upright in parallel to each other, the wire net and/or top board are set on the arm rests.

4. A portable cooking system comprising:

a plurality of leg units, each leg unit having a pair of leg posts, each pair of leg posts further comprising a front post and a rear post, a reinforcement mechanism that connects the leg units such that the units stand parallel with each other and are adapted to be folded together, a cloth material spread out horizontally over the reinforcement mechanism, a removable back cloth material that extends between the leg units, wherein the leg units, reinforcement mechanism, cloth material and back cloth form a bench, a removable wire net and top board each placed horizontal over the leg units, wherein with the back cloth material removed, the leg units, reinforcement mechanism, cloth material, and wire net and top board form a kitchen, and at least one removable lantern stand placed on each of the rear posts of the plurality of leg units.

* * * * *